US007632999B2

(12) United States Patent
Wilkerson

(10) Patent No.: US 7,632,999 B2
(45) Date of Patent: Dec. 15, 2009

(54) MUSICAL INSTRUMENT CASE

(76) Inventor: Alex J. Wilkerson, 1739 N. Gower St., Hollywood, CA (US) 90028

( * ) Notice: Subject to any disclaimer, the term of this patent is extended or adjusted under 35 U.S.C. 154(b) by 279 days.

(21) Appl. No.: 11/308,037

(22) Filed: Mar. 3, 2006

(65) Prior Publication Data

US 2007/0204742 A1 Sep. 6, 2007

(51) Int. Cl.
*G10D 13/02* (2006.01)
*G10D 9/00* (2006.01)
*G10D 1/08* (2006.01)

(52) U.S. Cl. ..... 84/421; 84/452 R; 84/290; 84/267; 84/453

(58) Field of Classification Search ..... 84/421, 84/327, 329, 385 A, 387 A, 452 R, 452 P
See application file for complete search history.

(56) References Cited

U.S. PATENT DOCUMENTS 4,147,254 A * 4/1979 Bruce ..... 206/314
4,531,632 A * 7/1985 Weber ..... 206/14
5,029,699 A * 7/1991 Insley et al. ..... 206/204
5,361,603 A * 11/1994 Merritt-Munson ..... 62/457.2
5,833,051 A * 11/1998 Tiefenbrun et al. ..... 206/14
6,441,288 B1 * 8/2002 Lin ..... 84/453
6,446,809 B2 * 9/2002 Flynn ..... 206/523
6,462,260 B2 * 10/2002 Fediakov ..... 84/327
6,670,536 B2 * 12/2003 Godin et al. ..... 84/453
6,812,393 B1 * 11/2004 Wilfer ..... 84/453
2003/0092344 A1 * 5/2003 Thompson et al. ..... 442/401

FOREIGN PATENT DOCUMENTS

JP 02204351 A * 8/1990
JP 03141140 A * 6/1991
JP 09085865 A * 3/1997
JP 10102306 A * 4/1998

* cited by examiner

*Primary Examiner*—Jeffrey Donels
*Assistant Examiner*—Christopher Uhlir
(74) *Attorney, Agent, or Firm*—James A. Italia; Italia IP

(57) ABSTRACT

A musical instrument case comprising a body which defines an outer and inner surface, first and second members, and a support layer affixed within the inner surface of the body and a microfiber layer affixed to the support layer.

21 Claims, 8 Drawing Sheets

CROSS SECTION

CROSS SECTION

MUSICAL INSTRUMENT CASE

FIELD OF THE INVENTION

This application relates generally to the field of devices that are used for the carrying of instruments. More specifically, this application relates to a musical instrument case that provides a microfiber surface about a portion of the case interior to prevent the scratching of the instrument contained therein.

BACKGROUND OF THE INVENTION

Musicians or would be musicians frequently carry their instruments in musical instrument cases that are designed to protect them during transport. Such traditional cases are lined with a variety of materials, however, in such traditional cases the materials used to line the cases cause damage to the instruments by imparting scratches to them while being carried and or when they are place in or removed from the case. Such scratches lessen the luster, overall appearance, and potentially the value of the instrument. As such, this application discloses various embodiments that enable a user to safely protect an instrument in a musical instrument case that will not cause scratches because of the use of microfiber about a portion of the case interior.

SUMMARY OF THE INVENTION

This application discloses various embodiments that enable a user to safely protect an instrument in a musical instrument case that will not cause scratches because of the use of microfiber about a portion of the case interior. The embodiments are economical to produce, of simple construction and capable of mass production.

In particular, the application discloses a musical instrument case comprising: a body defining an outer surface and an inner surface, a support layer affixed within said inner surface; and, a microfiber layer affixed upon said support layer, wherein said microfiber layer has a denier of approximately less than 1.0.

The application also discloses a musical instrument case comprising: a body defining an outer surface and an inner surface, a support layer affixed within said inner surface; and, a microfiber layer affixed upon said support layer, wherein said microfiber layer has a denier between approximately 0.6 and approximately 0.02.

Finally, the application also discloses a musical instrument case comprising: a body defining an outer surface and an inner surface, wherein said body is made of second and first members; hinging means attached to said second and first members so as to allow said second and first members to be movable between an open and closed position; a support layer affixed within said inner surface; a microfiber layer affixed upon said support layer, wherein said microfiber layer has a denier of approximately less than 1; latching means to prevent the case from inadvertently opening; and, carrying means for carrying said case.

DETAILED DESCRIPTION OF THE EMBODIMENTS

Figure 1:
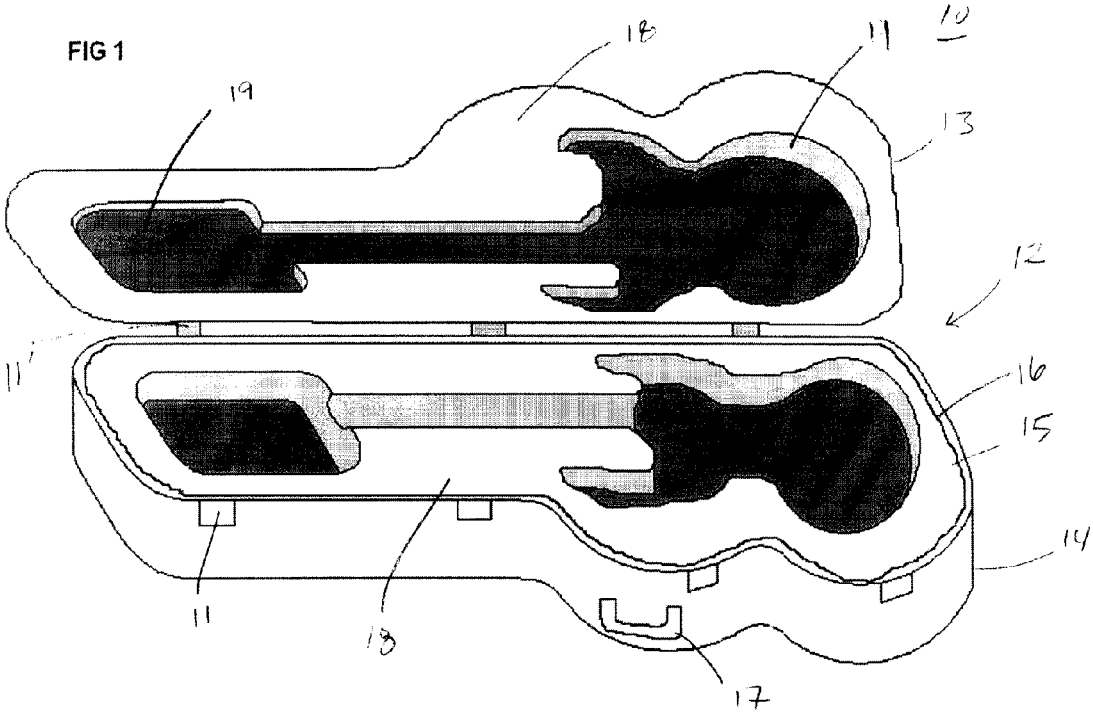
FIG. 1 is a perspective view of a first embodiment of the instrument case shown with the cover in its open position.
Figure 2:
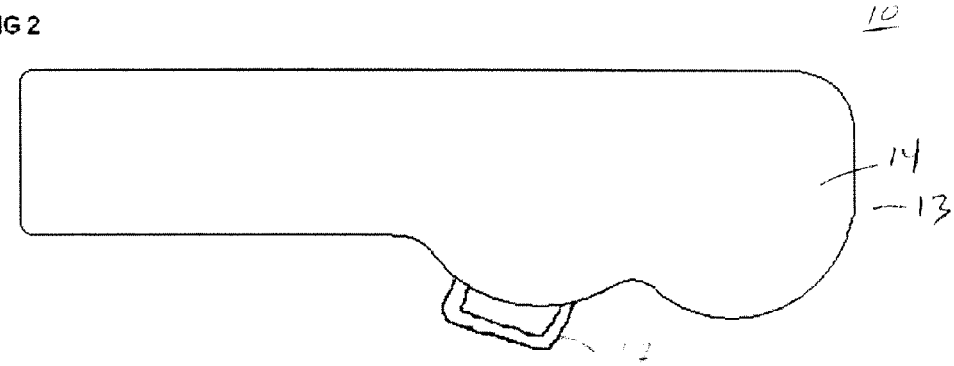
FIG. 2 is a top plan view of the instrument case of FIG. 1 with the cover in the closed position.
Figure 3:
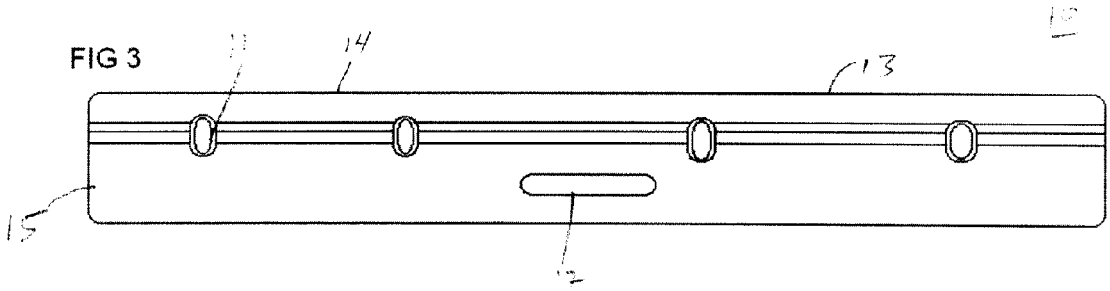
FIG. 3 is a front view of the instrument case of FIG. 1 with the cover in the closed position.
Figure 4:
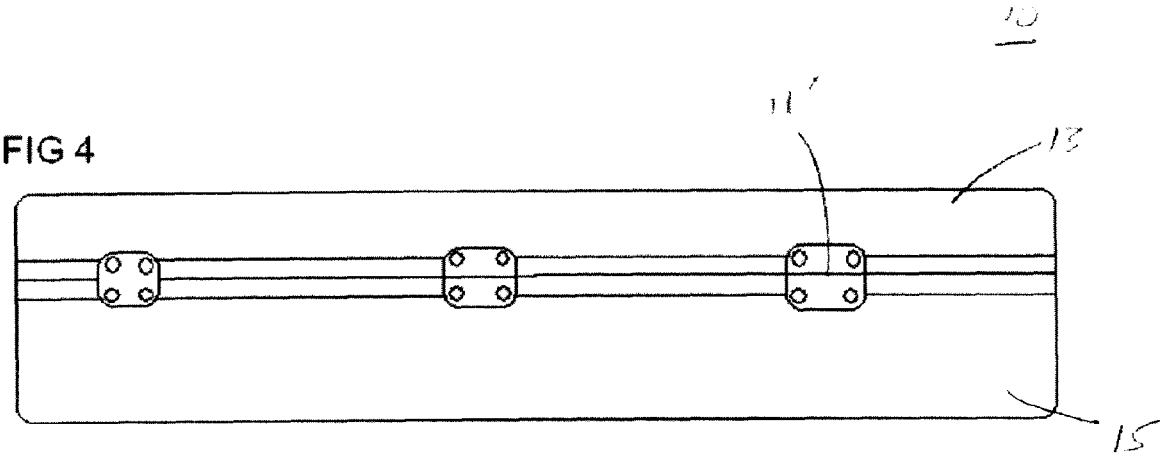
FIG. 4 is a rear view of the instrument case of FIG. 1 with the cover in the closed position.

Referring to FIGS. 1-4, the musical instrument case 10 includes a body 12 which defines an outer 14 and inner surface 16, first 13 and second members 15, and a support layer 18 affixed within the inner surface of said body that is contoured to mateably receive a particular instrument. The body of the instrument case is made of either a rigid or flexible material. For example, with the rigid or "hard case," material such as wood, metal, plastic, fiberglass or any other similar rigid material can be used. See FIG. 1. A latching assembly 11 is provided upon the outer surface 14 to keep the case 10 from inadvertently opening. Such latching means are well known in the art, and include hinges, hasps, drawbolts, locks, zippers, and are attached to the case 10 using standard fastening means, which are well known in the art. Further, the body 12 of the case 10 includes hinging means 11' which are well known in the art and that are attached using standard means such as rivets of other like means to the first 13 and second members 15 which allow the case 10 to move between an open and closed position. The case 10 also includes carrying means 17 that are well known in the art (such as a handle) and which attach using standard means known in the art. The outer surface 14 of the case may also be covered with an external layer, for example made of leather, or other weather resistant material (not shown).

Internally, the support layer 18 is made of foam (polypropylene or other similar material) that covers the entire or at least a portion of the inner surface 16 of the body 12. The support layer 18 is affixed to the inner surface 16 of the case using standard means that are well known in the art, including staples, rivets, glue, sewing or any other suitable means. The support layer 18 can be shaped or cut to mateably receive the desired instrument to be carried such that the support layer's inner dimensions are similar to the external dimensions of the musical instrument. See FIG. 1. Or, in a further embodiment, the support layer 18 may consist of a series of padding elements 42 that are positioned about the external dimension of the musical instrument so as to allow for the suspension of the instrument within the case. Here the term "suspension" is appreciated to mean that the periphery of the instrument is contact with the case. See FIG. 12. In this embodiment the support layer 18 receives the instrument in a discontinuous manner, but still provides the desired support. In this embodiment, it is further appreciated that the support layer padding elements 42 are of a rigid nature so as to adequately support the weight of the instrument and sufficiently rigid to prevent impact of the instrument when the case receives an impact.

Figure 12:
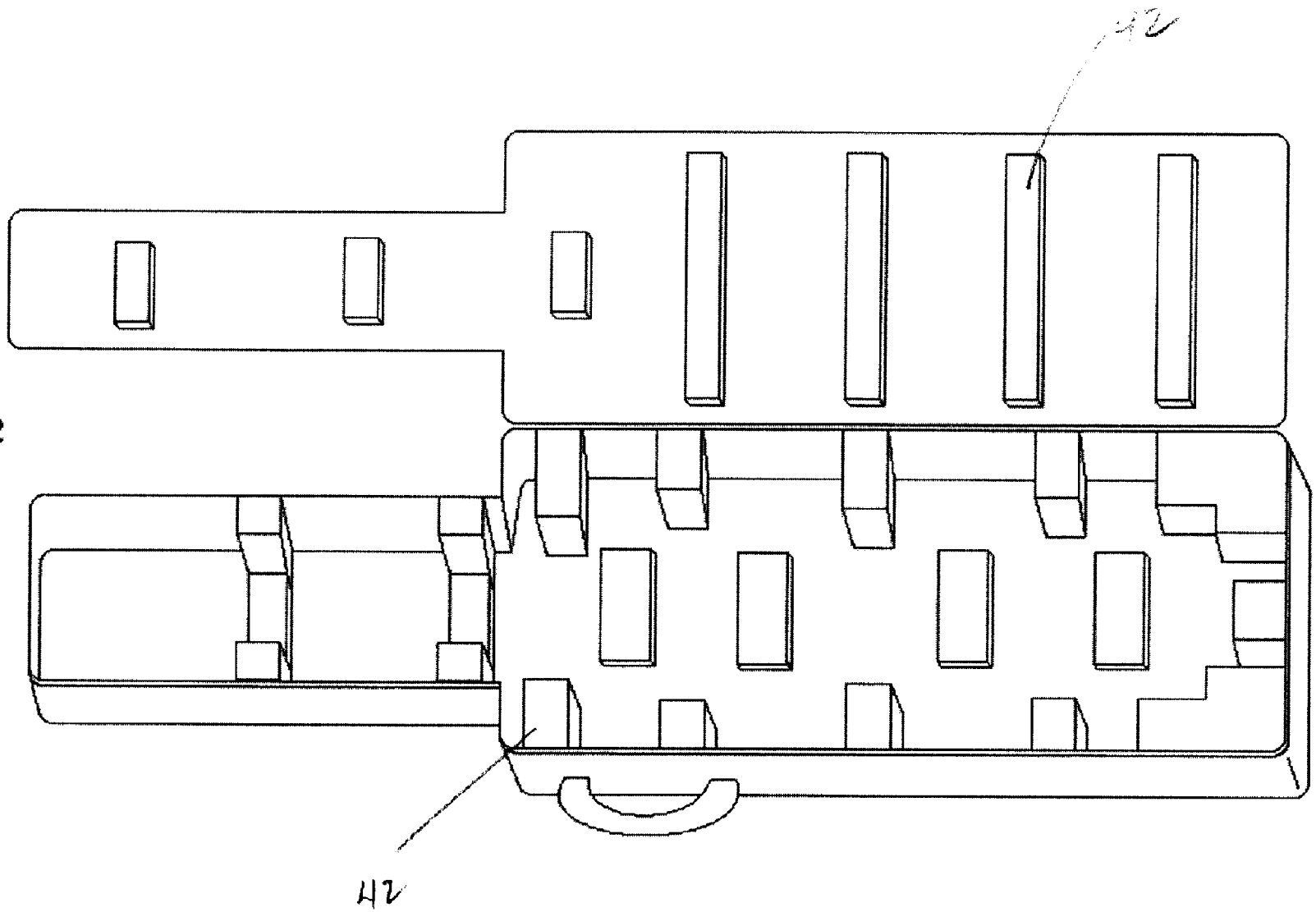
FIG. 12 is a perspective view of a fourth embodiment of the instrument case shown with the cover in its open position.

Referring to FIG. 12, each padding element 42 is made of a relatively high density foam, or similar material, that is affixed to the inner surface 16 of the case 10 in ways known in the art, including sewing, Velcro®, double sided adhesive tape, and any other like means.

Affixed to the support layer 18 and/or padding elements 42 is a layer of microfiber 19. See FIGS. 1 and 12. Microfiber or "micro fiber" and its characteristics and mode of production are well know in the arts. Microfiber is produced from a variety of synthetic fibers. One common microfiber combines two basic fibers, Polyester and Polyamide. As well known in the art, these fibers are usually "split" and formed into a woven fabric of 80% Polyester and 20% Polyamide. Microfiber is also formed in a similar manner as above using a 70% Polyester and 30% Polyamide weave. Both types and equivalent fibers that fall in the approximately less than one denier rating are contemplated for use in this invention. Microfiber that falls in the range of approximately 0.6 and approximately 0.02 is particularly preferred. The microfiber layer 19 is affixed to the support layer 18 and/or padding elements 42 using standard means that are well known in the art, including staples, rivets, glue, Velcro®, double sided adhesive tape, sewing or any other suitable means. It is contemplated that the microfiber layer may be affixed either to the entire surface of the support layer 18 and/or padding elements 42, only in portions where the support layer 18 and padding elements 42 come in contact with instrument when carried in the case, and variations that fall between such degrees.

Figure 13:
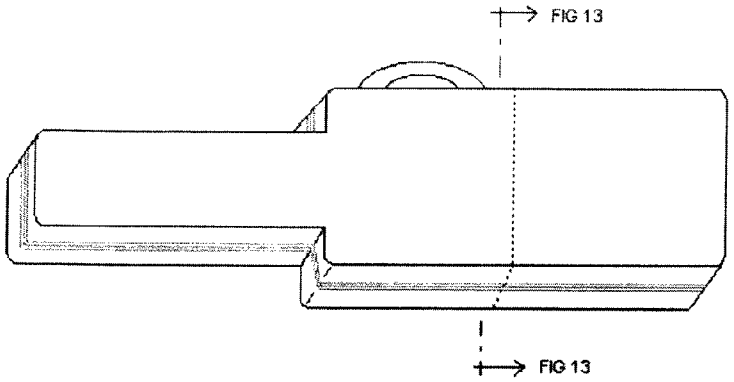
FIG. 13 is a sectional view of the layer structure of the instrument case of FIG. 1.
Figure 13:
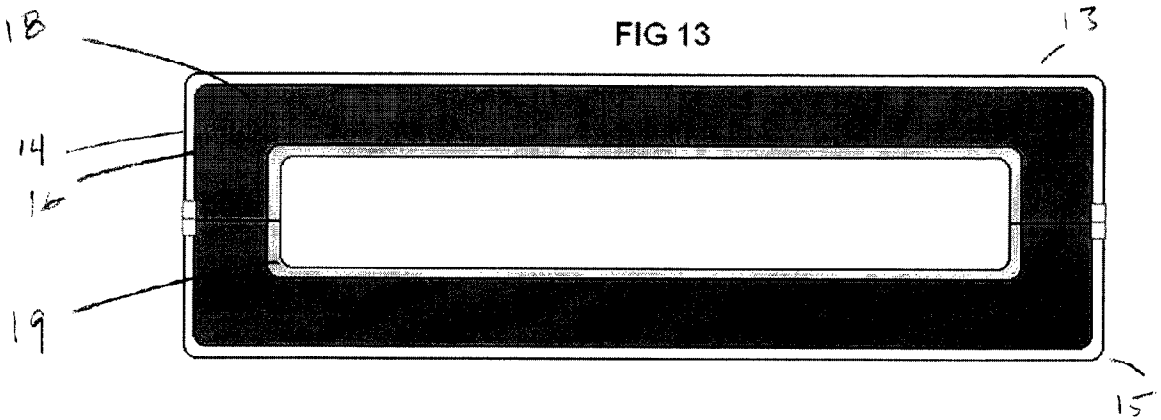

FIG. 13 is a sectional view illustrating the multilayer structure of the case 10 shown in FIGS. 1-4. To restate, the case 10 includes a body 12 which defines an outer 14 and inner surface 16, first 13 and second members 15, and a support layer 18 affixed within the inner surface 16. Affixed to the support layer 18 is a layer of microfiber 19.

Figure 5:
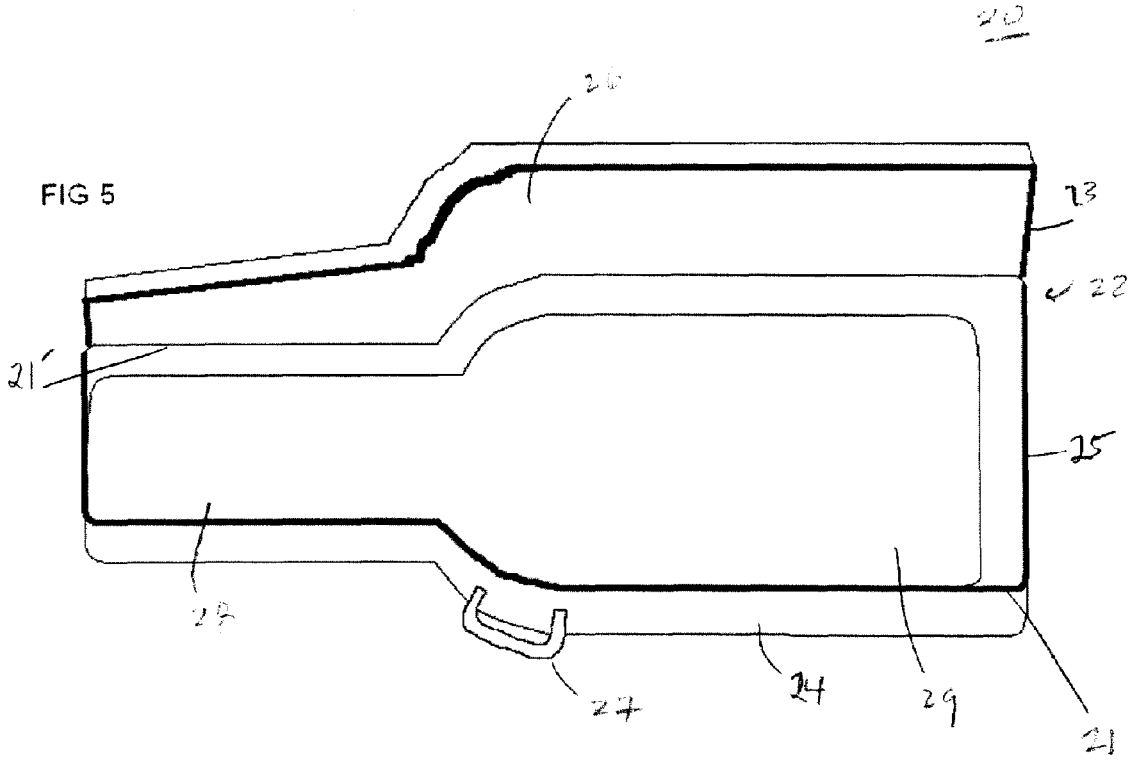
FIG. 5 is a perspective view of a second embodiment of the instrument case shown with the cover in its open position.
Figure 6:
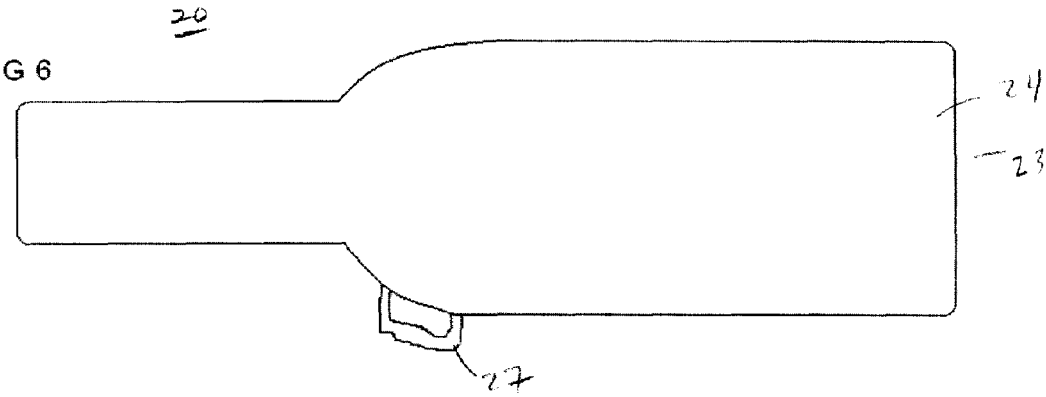
FIG. 6 is a top plan view of the instrument case of FIG. 5 with the cover in the closed position.
Figure 7:
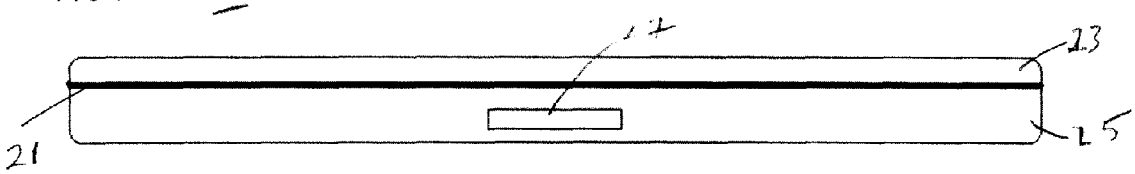
FIG. 7 is a front view of the instrument case of FIG. 5 with the cover in the closed position.
Figure 8:
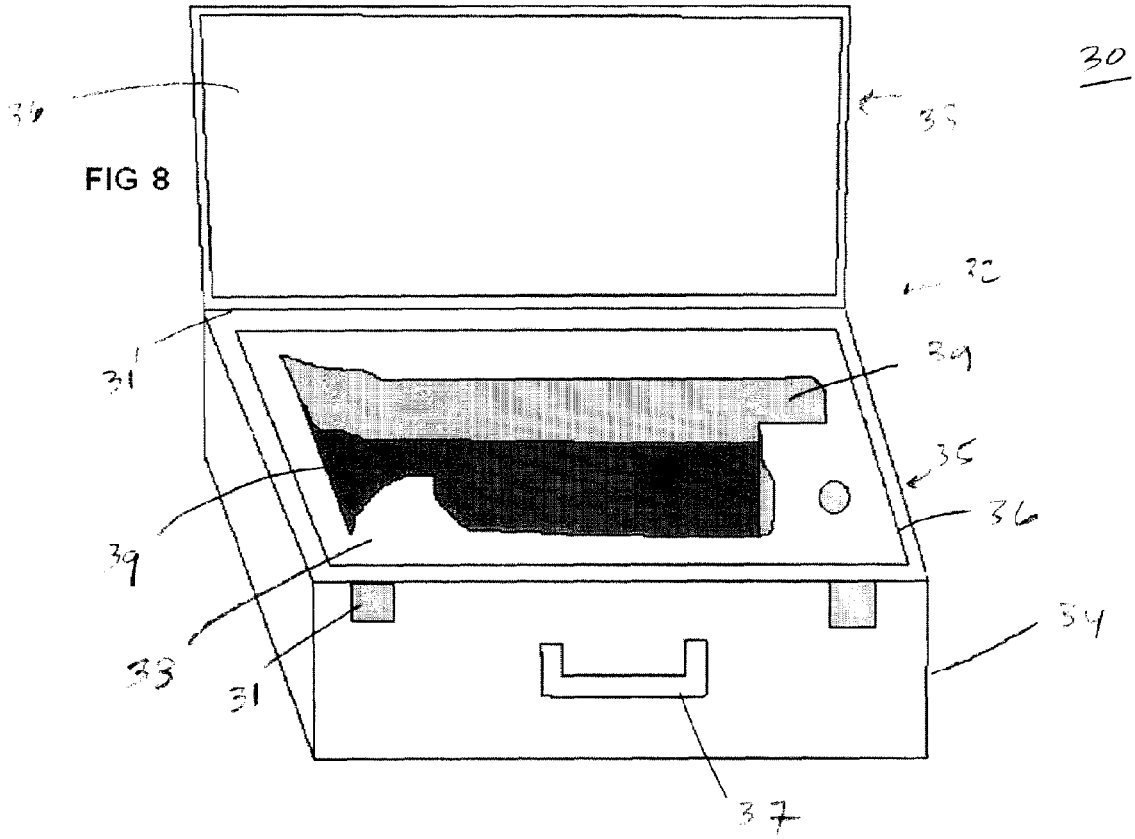
FIG. 8 is a perspective view of a third embodiment of the instrument case shown with the cover in its open position.
Figure 9:
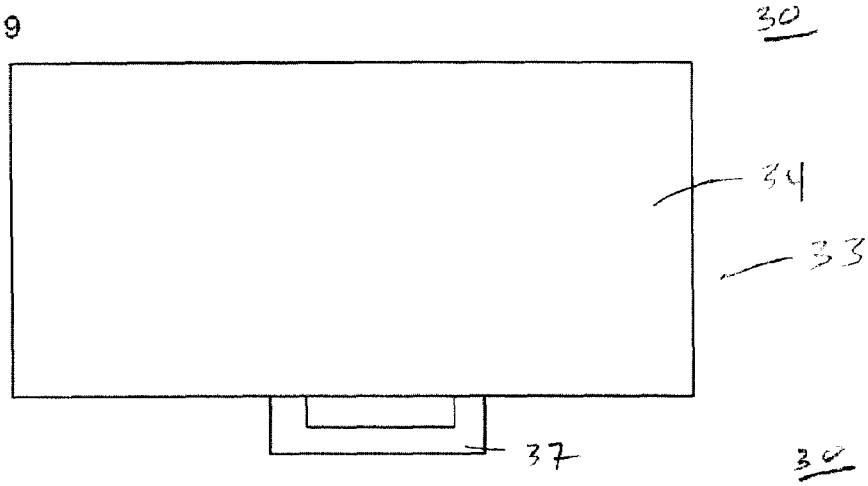
FIG. 9 is a top plan view of the instrument case of FIG. 8 with the cover in the closed position.
Figure 10:
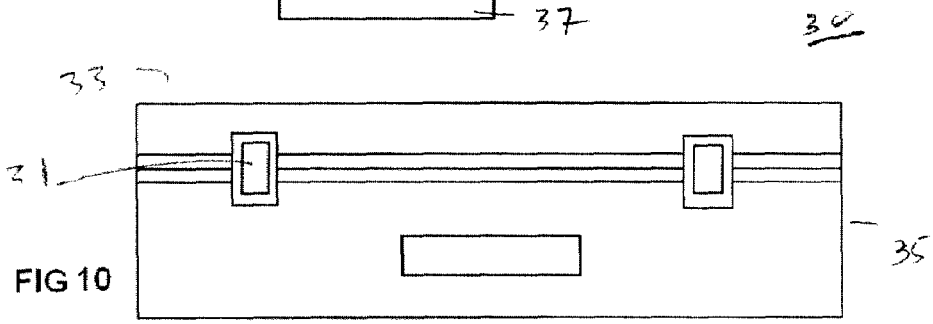
FIG. 10 is a front view of the instrument case of FIG. 8 with the cover in the closed position.
Figure 11:
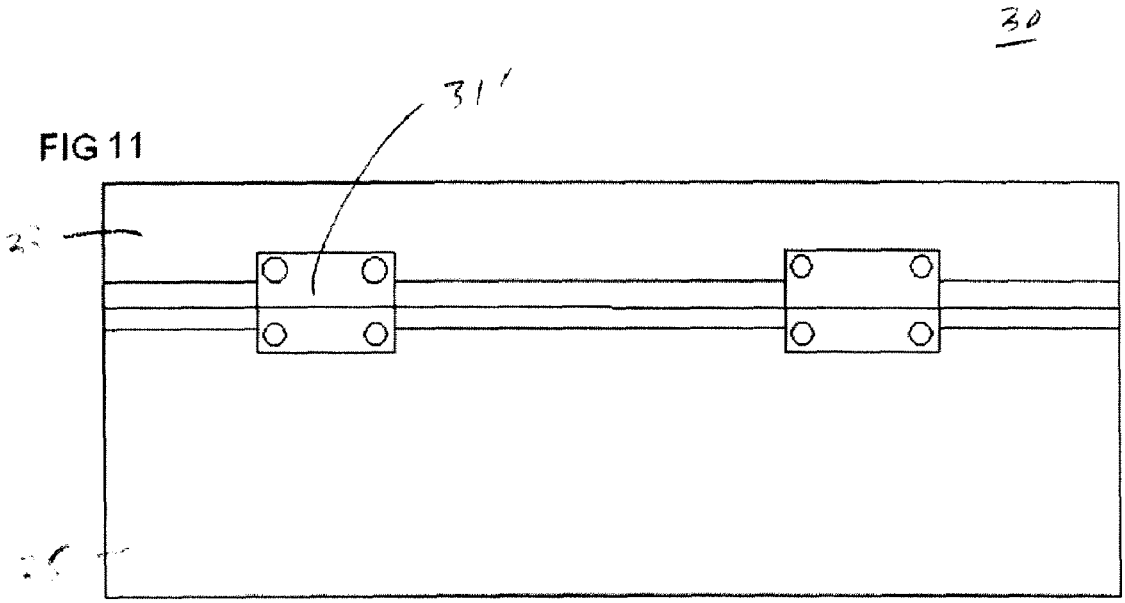
FIG. 11 is a rear view of the instrument case of FIG. 8 with the cover in the closed position.

Referring to FIGS. 5-7, a further embodiment is shown. Here the musical instrument case 20 has a flexible or non-rigid body 22 which defines an outer 24 and inner surface 26. The body 22 is made of a lightweight durable material such as nylon or other similar material, such as, for example Cordura™. Flexible cases of this type are commonly known as "gig bags."

A latching assembly 21 is provided upon the outer surface 24 to keep the case 20 from inadvertently opening. Such latching means are well known in the art and for such flexible cases, zippers are generally preferred, however, other latching means are contemplated which include hinges, hasps, drawbolts, locks, and are attached to the case 20 using standard fastening means, which are well known in the art. Further the body 22 of the case 20 includes hinging means 21' which are well known in the art and that are attached using standard means such as rivets of other like means to the first 23 and second members 25 which allow the case 20 to move between an open and closed position. With flexible bags, the hinging means is generally the folding of the fabric back on itself when the case is opened. The case 20 also includes carrying means 27 that are well known in the art (such as a handle) and which attach using standard means known in the art. The outer surface 24 of the case may also be covered with an external layer, for example made of leather, or other weather resistant material (not shown).

Internally, the support layer 28 is made of foam (polypropylene or other similar material) that covers the entire or at least a portion of the inner surface 16 of the body 12. The support layer 28 is affixed to the inner surface 26 of the case using standard means that are well known in the art, including staples, rivets, glue, sewing or any other suitable means. The support layer 28 can be shaped or cut to mateably receive the desired instrument to be carried such that the support layer's inner dimensions are similar to the external dimensions of the musical instrument. See FIG. 5. Or, in a further embodiment, the support layer 28 may consist of a series of padding elements 42 as shown in FIG. 12 that are positioned about the external dimension of the musical instrument so as to allow for the suspension of the instrument within the case. Here the term "suspension" is appreciated to mean that the periphery of the instrument is contact with the case. See FIG. 12. In this embodiment the support layer 28 receives the instrument in a discontinuous manner, but still provides the desired support. In this embodiment, it is further appreciated that the support layer padding elements 42 are of a rigid nature so as to adequately support the weight of the instrument and sufficiently rigid to prevent impact of the instrument when the case receives an impact.

Affixed to the support layer 28 and/or padding elements 42 is a layer of microfiber 29. See FIGS. 5 and 12. The microfiber layer 29 is affixed to the support layer 28 and/or padding elements 42 using standard means that are well known in the art, including staples, rivets, glue, sewing or any other suitable means. It is contemplated that the microfiber layer may be affixed either to the entire surface of the support layer 28 and/or padding elements 42, only in portions where the support layer 28 and padding elements 42 come in contact with instrument when carried in the case, and variations that fall between such degrees. The microfiber types described above and equivalent fibers that fall in the approximately less than one denier rating are contemplated for use in this invention. Microfiber that falls in the range of approximately 0.6 and approximately 0.02 is particularly preferred.

Figure 14:
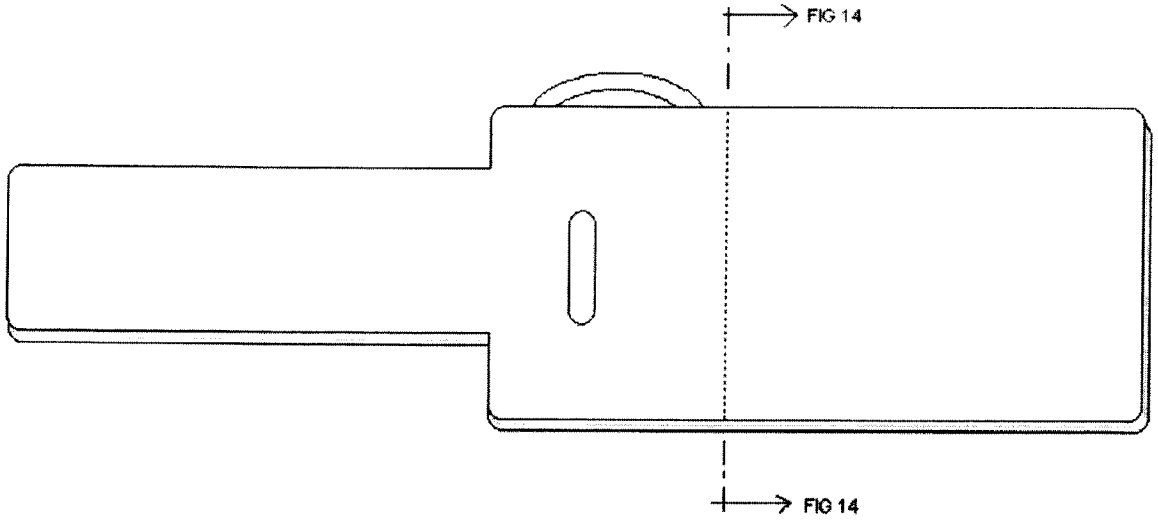
FIG. 14 is a sectional view of the layer structure on the instrument case of FIG. 5
Figure 14:
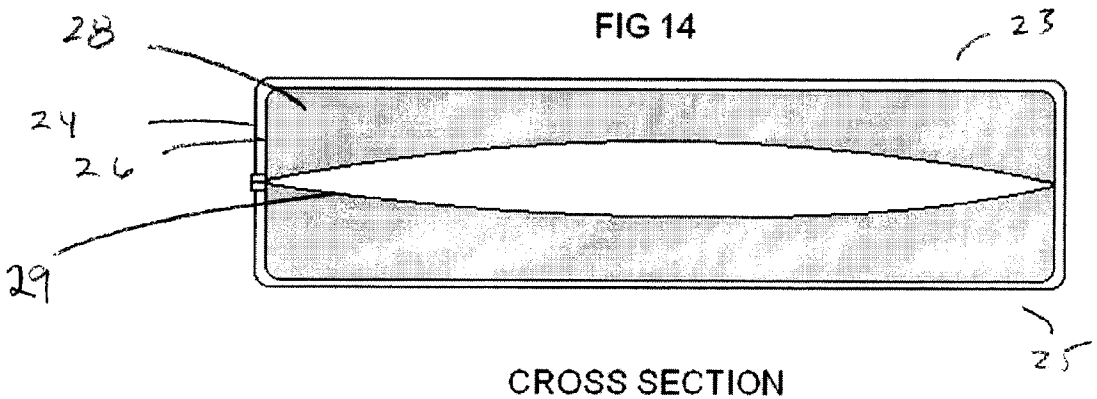

FIG. 14 is a sectional view illustrating the multilayer structure of the case 20 shown in FIGS. 5-7. To restate, the case 20 includes a body 22 which defines an outer 24 and inner surface 26, first 23 and second members 25, and a support layer 28 affixed within the inner surface 26. Affixed to the support layer 28 is a layer of microfiber 29.

In the embodiments and figures described above, the musical instrument case is shaped to carry a guitar, however, it is contemplated that the present disclosure is applicable to all types of musical instruments. The musical instrument case disclosure would apply to all string, brass, percussion, woodwind, and any other types of musical instruments. For example, FIGS. 8-11, indicate a musical instrument case of the present disclosure for a brass instrument. Referring to FIGS. 8-11, the musical instrument case 30 includes a body 32 which defines an outer 34 and inner surface 36, first 33 and second members 35, and a support layer 38 affixed within the inner surface of said body that is contoured to mateably receive a particular instrument. The body of the instrument case 32 is made of either a rigid or flexible material. For example, with the rigid or "hard case," material such as wood, metal, plastic, fiberglass or any other similar rigid material can be used. See FIG. 8. A latching assembly 31 is provided upon the outer surface 34 to keep the case 30 from inadvertently opening. Such latching means are well known in the art, and include hinges, hasps, drawbolts, locks, zippers, and are attached to the case 30 using standard fastening means, which are well known in the art. Further the body 32 of the case 30 includes hinging means 31' which are well known in the art and that are attached using standard means such as rivets of other like means to the first 33 and second members 35 which allow the case 30 to move between an open and closed position. The case 30 also includes carrying means 37 that are well known in the art and which attach using standard means known in the art. The outer surface 34 of the case may also be covered with an external layer, for example made of leather, or other weather resistant material (not shown).

Internally, the support layer 38 is made of foam (polypropylene or other similar material) that covers the entire or at least a portion of the inner surface 36 of the body 32. The support layer 38 is affixed to the inner surface 36 of the case using standard means that are well known in the art, including staples, rivets, glue, sewing or any other suitable means. The support layer 38 can be shaped or cut to mateably receive the desired instrument to be carried such that the support layer's inner dimensions are similar to the external dimensions of the musical instrument. See FIG. 8. Or, in a further embodiment, the support layer 38 may consist of a series of padding elements 42 that are positioned about the external dimension of the musical instrument so as to allow for the suspension of the instrument within the case. Again, the term "suspension" is appreciated to mean that the periphery of the instrument is contact with the case. See FIG. 12. In this embodiment the support layer 38 receives the instrument in a discontinuous manner, but still provides the desired support. In this embodiment, it is further appreciated that the support layer padding elements 42 are of a rigid nature so as to adequately support the weight of the instrument and sufficiently rigid to prevent impact of the instrument when the case receives an impact.

Affixed to the support layer 38 and/or padding elements 42 is a layer of microfiber 19. See FIGS. 8 and 12. The microfiber layer 39 is affixed to the support layer 38 and/or padding elements 42 using standard means that are well known in the art, including staples, rivets, glue, sewing or any other suitable means. It is contemplated that the microfiber layer may be affixed either to the entire surface of the support layer 38 and/or padding elements 42, only in portions where the support layer 38 and padding elements 42 come in contact with instrument when carried in the case, and variations that fall between such degrees. The microfiber types described above and equivalent fibers that fall in the approximately less than one denier rating are contemplated for use in this invention. Microfiber that falls in the range of approximately 0.6 and approximately 0.02 is particularly preferred.

Although the present disclosure has been described hereinabove by way of preferred embodiments thereof, it can be modified, without departing from the spirit and nature of the disclosure as defined in the appended claims.

What is claimed is:

1. A musical instrument case for holding an instrument comprising:

a body defining an outer surface and an inner surface, a support layer affixed within said inner surface; and, a microfiber layer affixed upon said support layer, wherein said microfiber layer is made of 70-80% Polyester and 20-30% Polyamide woven together, said microfiber layer has a denier of approximately 0.6 and 0.2, and wherein a portion of said microfiber layer is in contact with said instrument when placed in said case.

2. The musical instrument case of claim 1, wherein the musical instrument is a guitar.

3. The musical instrument case of claim 1, wherein said outer surface of said body is made of a rigid material.

4. The musical instrument case of claim 3, wherein said body is made of second and first members hingedly attached to one another so as to allow said second and first members to be movable between an open and closed position.

5. The musical instrument case of claim 4, further comprising latching means to prevent the case from inadvertently opening.

6. The musical instrument case of claim 5, wherein the musical instrument is a guitar.

7. The musical instrument case of claim 1, wherein said outer surface of said body is made of a flexible material.

8. The musical instrument case of claim 7, wherein said body is made of second and first members hingedly attached to one another so as to allow said second and first members to be movable between an open and closed position.

9. The musical instrument case of claim 8, further comprising latching means to prevent the case from inadvertently opening.

10. The musical instrument case of claim 9, wherein the musical instrument is a guitar.

11. A musical instrument case for holding an instrument comprising:

a body defining an outer surface and an inner surface, a support layer affixed within said inner surface; and, a microfiber layer affixed upon said support layer, wherein said microfiber layer is made of 70-80% Polyester and 20-30% Polyamide woven together, said microfiber layer has a denier between approximately 0.6 and approximately 0.02, and wherein a portion of said microfiber layer is in contact with said instrument when placed in said case.

12. The musical instrument case of claim 11, wherein the musical instrument is a guitar.

13. The musical instrument case of claim 11, wherein said outer surface of said body is made of a rigid material.

14. The musical instrument case of claim 13, wherein said body is made of second and first members hingedly attached to one another so as to allow said second and first members to be movable between an open and closed position.

15. The musical instrument case of claim 14, further comprising latching means to prevent the case from inadvertently opening.

16. The musical instrument case of claim 15, wherein the musical instrument is a guitar.

17. The musical instrument case of claim 11, wherein said outer surface of said body is made of a flexible material.

18. The musical instrument case of claim 17, wherein said body is made of second and first members hingedly attached to one another so as to allow said second and first members to be movable between an open and closed position.

19. The musical instrument case of claim 18, further comprising latching means to prevent the case from inadvertently opening.

20. The musical instrument case of claim 19, wherein the musical instrument is a guitar.

21. A musical instrument case for holding an instrument comprising:

a body defining an outer surface and an inner surface, wherein said body is made of second and first members;

hinging means attached to said second and first members so as to allow said second and first members to be movable between an open and closed position;

a support layer affixed within said inner surface;

a microfiber layer affixed upon said support layer, wherein said microfiber layer is made of 70-80% Polyester and 20-30% Polyamide woven together, said microfiber layer has a denier of approximately 0.6 and 0.2, and wherein a portion of said microfiber layer is in contact with said instrument when placed in said case;

latching means to prevent the case from inadvertently opening; and, carrying means for carrying said case.

* * * * *